US011746534B2

(12) United States Patent
Cusa et al.

(10) Patent No.: US 11,746,534 B2
(45) Date of Patent: Sep. 5, 2023

(54) SOUND DAMPING WALLBOARD AND METHOD OF CONSTRUCTING A SOUND DAMPING WALLBOARD

(71) Applicant: National Gypsum Properties, LLC, Charlotte, NC (US)

(72) Inventors: Stephen A. Cusa, Downingtown, PA (US); Michael N. Blades, Indian Land, SC (US); Richard P. Weir, Indian Trail, NC (US); John W. Mixson, Charlotte, NC (US)

(73) Assignee: Gold Bond Building Products, LLC, Charlotte, NC (US)

( * ) Notice: Subject to any disclaimer, the term of this patent is extended or adjusted under 35 U.S.C. 154(b) by 0 days.

(21) Appl. No.: 15/017,362

(22) Filed: Feb. 5, 2016

(65) Prior Publication Data

US 2016/0230395 A1 Aug. 11, 2016

Related U.S. Application Data

(60) Provisional application No. 62/112,560, filed on Feb. 5, 2015.

(51) Int. Cl.
*E04B 1/86* (2006.01)
*E04F 13/08* (2006.01)
(Continued)

(52) U.S. Cl.
CPC ..... *E04F 13/0867* (2013.01); *E04B 1/86* (2013.01); *E04B 1/99* (2013.01); *E04F 13/0875* (2013.01);
(Continued)

(58) Field of Classification Search
CPC ..... E04B 1/86; E04B 1/99; E04B 2001/8461; E04F 13/0867; E04F 13/0875; E04F 13/14; E04F 2290/043
(Continued)

(56) References Cited

U.S. PATENT DOCUMENTS 1,867,797 A 7/1932 Armstrong
2,045,311 A * 6/1936 Roos ..... E04B 1/82 156/71
(Continued)

FOREIGN PATENT DOCUMENTS

EP 1251215 10/2002
GB 1489825 10/1977
(Continued)

OTHER PUBLICATIONS

CSTB, Document Technique d'Application: Knauf BA25—BA18/900, Jul. 18, 2010 (www.ctsb.fr/pdf/atec/GS09-J/AJ090884_V1.pdf).

*Primary Examiner* — Brian E Glessner
*Assistant Examiner* — James Buckle, Jr.
(74) *Attorney, Agent, or Firm* — Dority & Manning, P.A.

(57) ABSTRACT

A sound damping wallboard for installation on an installed wallboard, a sound damping wallboard system, and a method of constructing a sound damping wallboard on a building structure are disclosed. The sound damping wallboard comprises a gypsum layer having a gypsum layer inner surface and a gypsum layer outer surface, a sound damping layer disposed at the gypsum layer inner surface for installation between the gypsum layer and an installed wallboard and having a sound damping layer inner surface, a first encasing layer disposed at the gypsum layer outer surface, and a second encasing layer disposed at the sound damping layer inner surface.

14 Claims, 6 Drawing Sheets

(51) Int. Cl.
*E04F 13/14* (2006.01)
*E04B 1/99* (2006.01)
*E04B 1/84* (2006.01)

(52) U.S. Cl.
CPC ..... *E04F 13/14* (2013.01); *E04B 2001/8461* (2013.01); *E04F 2290/043* (2013.01)

(58) Field of Classification Search
USPC ..... 52/144
See application file for complete search history.

(56) References Cited

U.S. PATENT DOCUMENTS 2,045,312 A * 6/1936 Roos ..... E04B 1/82 52/144
3,350,257 A 10/1967 Hourigan et al.
3,424,270 A * 1/1969 Hartman ..... C08L 7/00 156/281
3,562,092 A 2/1971 Oberst et al.
3,894,169 A * 7/1975 Miller ..... E04B 1/82 181/207
4,663,224 A 5/1987 Tabata et al.
5,103,614 A 4/1992 Kawaguchi et al.
5,125,475 A * 6/1992 Ducharme ..... E04B 1/86 181/284
5,258,585 A * 11/1993 Juriga ..... B29C 43/203 181/286
5,438,806 A 8/1995 Reinhall
5,477,652 A 12/1995 Torrey et al.
5,502,931 A 4/1996 Munir
5,543,193 A 8/1996 Tesch
5,584,950 A 12/1996 Gaffigan
5,691,037 A 11/1997 McCutcheon et al.
5,975,238 A * 11/1999 Fuchs ..... E04B 1/8209 181/286
6,145,617 A 11/2000 Alts
6,309,985 B1 10/2001 Virnelson et al.
6,901,713 B2 * 6/2005 Axsom ..... E04B 1/80 52/309.17
7,181,891 B2 2/2007 Surace et al.
7,603,824 B1 10/2009 Hartanto
7,705,101 B2 4/2010 Sherman et al.
7,745,005 B2 6/2010 Tinianov
7,798,287 B1 * 9/2010 Surace ..... B32B 15/06 181/286
7,799,410 B2 9/2010 Tinianov
7,883,763 B2 2/2011 Tinianov
7,921,965 B1 4/2011 Surace
8,181,417 B2 5/2012 Surace et al.
8,349,444 B2 1/2013 Kipp et al.
8,590,670 B1 11/2013 Grube et al.
9,033,102 B2 5/2015 Payot et al.
9,387,649 B2 7/2016 Tinianov et al.
9,388,568 B2 7/2016 Tinianov
9,637,913 B2 * 5/2017 Ravnaas ..... E04B 1/86
2002/0028332 A1 3/2002 Pratt
2002/0081410 A1 6/2002 Buckwalter et al.
2003/0070367 A1 4/2003 Gelin et al.
2003/0141144 A1 7/2003 Wilson
2004/0048022 A1 3/2004 Pratt
2004/0219322 A1 11/2004 Fisher et al.
2005/0080193 A1 4/2005 Wouters et al.
2005/0196608 A1 9/2005 Wouters et al.
2005/0255318 A1 * 11/2005 Czerny ..... B60R 13/08 428/402
2006/0000670 A1 1/2006 Dodd
2006/0191743 A1 8/2006 Pike et al.
2007/0137139 A1 * 6/2007 Tierney ..... B32B 27/12 52/748.1
2007/0175173 A1 8/2007 Babineau, Jr. et al.
2008/0178544 A1 * 7/2008 Clark ..... E04B 1/90 52/270
2008/0251198 A1 10/2008 Tinianov
2008/0264721 A1 10/2008 Tinianov et al.
2009/0004448 A1 1/2009 Tinianov
2009/0107059 A1 * 4/2009 Kipp ..... C04B 28/26 52/144
2009/0239429 A1 * 9/2009 Kipp ..... C04B 28/26 442/1
2009/0280356 A1 11/2009 Tinianov et al.
2010/0038169 A1 2/2010 Lee
2010/0066121 A1 3/2010 Gross
2010/0126800 A1 5/2010 Albin, Jr.
2010/0180916 A1 7/2010 Colon et al.
2010/0230206 A1 9/2010 Tinianov et al.
2010/0258378 A1 10/2010 Ravnaas
2011/0064916 A1 3/2011 Sherman et al.
2011/0271638 A1 11/2011 Tierney et al.
2011/0296794 A1 12/2011 Thomas et al.
2012/0024626 A1 2/2012 Coates et al.
2012/0058289 A1 3/2012 Coates et al.
2012/0073899 A1 * 3/2012 Fournier ..... B32B 7/12 181/294
2013/0087409 A1 4/2013 Payot et al.
2013/0240111 A1 9/2013 Tinianov
2015/0218804 A1 8/2015 Payot et al.
2015/0322670 A1 11/2015 Hotchin et al.

FOREIGN PATENT DOCUMENTS

GB 2499063 8/2013
JP S54-44971 12/1979
WO 2010042993 4/2010

* cited by examiner

SOUND DAMPING WALLBOARD AND METHOD OF CONSTRUCTING A SOUND DAMPING WALLBOARD

This application claims the benefit of U.S. Provisional Application No. 62/112,560, filed Feb. 5, 2015, which is hereby incorporated by reference in its entirety. A building is typically constructed with walls having a frame comprising vertically oriented studs connected by horizontally oriented top and bottom plates or tracks. The walls often include one or more gypsum wallboards fastened to the studs and/or plates on each side of the frame or, particularly for exterior walls, one or more gypsum wallboards fastened to the studs and/or plates on one side of the frame with a non-gypsum based sheathing attached to an exterior side of the frame. A ceiling of the building may also include one or more gypsum wallboards oriented horizontally and fastened to joists, studs, or other structural members extending horizontally in the building. Walls and ceilings of this construction often have poor acoustical performance and a low sound transmission class (STC) rating, which results in noise pollution, lack of privacy, and similar issues in the various spaces of the building. One of the aspects of this poor performance is the coincidence between the human voice Hertz spectrum and the vibrational Hertz range of standard gypsum wallboard, which creates a unique dip in the acoustical curve of a standard frame and gypsum wallboard wall.

BACKGROUND

One method to improve acoustical performance of the walls and ceilings is to install insulation in the cavities of the walls before attaching wallboards to the wall frame. Other methods include the use of rubber sheets, clips, or panels attached to the frame during wall or ceiling construction. However, most of the current methods to improve wall or ceiling acoustical performance must be implemented during the initial wall or ceiling construction, and these conventional methods do not overcome the coincidence issue of standard gypsum wallboard discussed above. Further, the resulting wall may be significantly thicker than traditionally-constructed walls due to the addition of the sound damping materials.

Therefore, there exists a need for a sound damping wallboard that is structured for retrofit installation and attachment to a wallboard or other panel of wall material previously installed onto the frame of a wall to improve the acoustical performance of the wall and, in particular, help address any coincidence issues. Further, there exists a need for a sound damping wallboard for attachment to an installed wallboard or wall panel whereby the sound damping wallboard is sufficiently thin to minimize the skill and labor needed for installation, minimize the increase in overall wall thickness, avoid costly and labor-intensive modifications to installed wall and ceiling objects, such as existing wall outlets, switches, and wall or ceiling fixtures, and minimize any reduction in living space within the structure causing a reduction in the value of the structure.

SUMMARY

In accordance with an aspect of the disclosure, a sound damping wallboard is provided, that comprises a gypsum layer having a gypsum layer inner surface and a gypsum layer outer surface. A sound damping layer is disposed at the gypsum layer inner surface and has a sound damping layer inner surface opposite the gypsum layer inner surface. A first encasing layer is disposed at the gypsum layer outer surface, and a second encasing layer is disposed at the sound damping layer inner surface.

In accordance with another aspect of the disclosure, a sound damping wallboard system for a building structure is provided that comprises a first wallboard fastened to the building structure. A second wallboard comprises a gypsum layer having a gypsum layer inner surface and a gypsum layer outer surface. A sound damping layer is disposed at the gypsum layer inner surface and has a sound damping layer inner surface opposite the gypsum layer inner surface. A first encasing layer is disposed at the gypsum layer outer surface, and a second encasing layer is disposed at the sound damping layer inner surface. The second wallboard is fastened to the first wallboard with the sound damping layer inner surface disposed at the first wallboard.

In accordance with yet another aspect of the disclosure, a method of constructing a sound damping wallboard on a building structure is provided that comprises the steps of fastening a first wallboard to the building structure; providing a second wallboard that comprises a gypsum layer having an inner surface and an outer surface, a sound damping layer having a first surface disposed at the gypsum layer inner surface and a second surface opposite the first surface, a first encasing layer disposed at the gypsum layer outer surface, and a second encasing layer disposed at the sound damping layer second surface; and fastening the second wallboard to the first wallboard with the sound damping layer disposed between the gypsum layer and the first wallboard.

BRIEF DESCRIPTION OF THE FIGURES

The embodiments described herein and other features, advantages, and disclosures contained herein, and the manner of attaining them, will be better understood from the following description in conjunction with the accompanying drawing figures, in which like reference numerals identify like elements, and wherein.

DETAILED DESCRIPTION

In the following detailed description of embodiments of the present disclosure, reference is made to the accompanying drawings that form a part hereof, and in which is shown by way of illustration, and not by way of limitation, such specific embodiments. It is to be understood that other embodiments may be utilized and that changes may be made without departing from the spirit and scope of the present disclosure.

Figure 1:
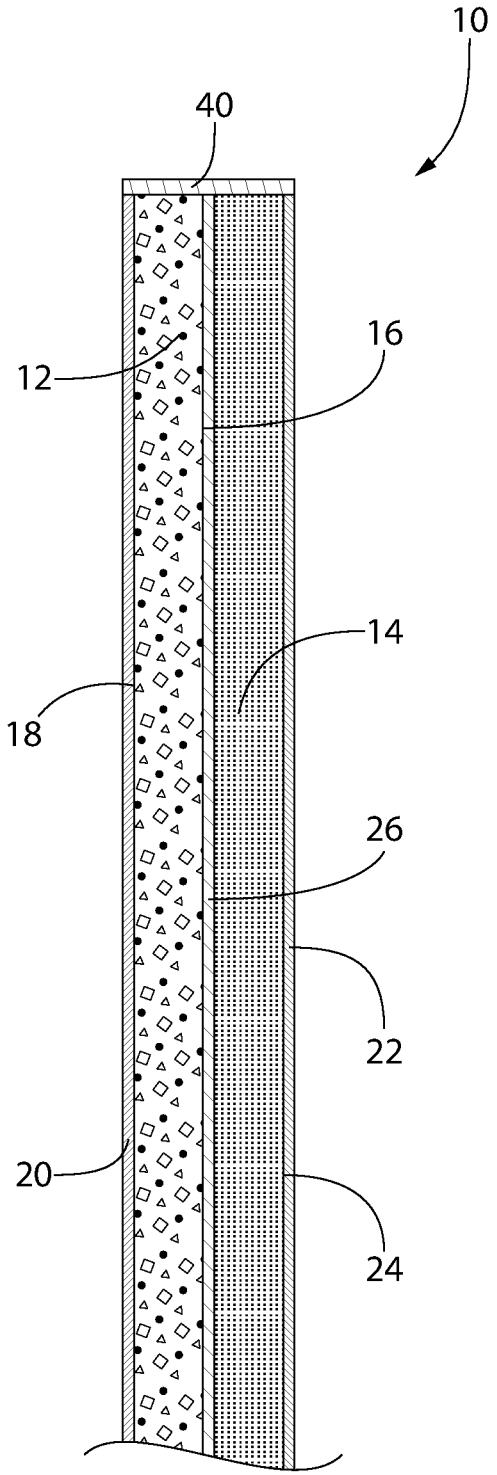
FIG. 1 is a cross sectional view of a sound damping wallboard in accordance with aspects of the present disclosure.

Reference is now made to FIG. 1, which shows a sound damping wallboard 10 according to an embodiment of the present disclosure. The sound damping wallboard 10 of an embodiment generally includes a gypsum layer 12 and a sound damping layer 14, that are sandwiched between first and second encasing layers 20 and 22. The gypsum layer 12 includes a gypsum layer inner surface 16 and a gypsum layer outer surface 18. The sound damping layer 14 is disposed at the gypsum layer inner surface 16. The first encasing layer 20 is disposed at the gypsum layer outer surface 18 and the second encasing layer 22 is disposed at a sound damping layer inner surface 24 opposite the gypsum layer inner surface 16. In an embodiment, a third encasing layer 26 is disposed between the gypsum layer 12 and the sound damping layer 14. In an embodiment, the gypsum layer 12 is constructed using conventional gypsum wallboard manufacturing techniques, including encasing the gypsum layer 12 in an encasing material such that an encasing layer is disposed on each of the gypsum layer inner surface 16 and the gypsum layer outer surface 18, thereby forming the first encasing layer 20 and the third encasing layer 26. In an embodiment, the gypsum layer 12 has a higher density than a density of a gypsum layer of a conventional gypsum wallboard.

In one or more embodiments, the sound damping layer 14 comprises a resin or polymeric material, and preferably an elastomer. Suitable sound damping materials include, as non-limiting examples, synthetic resins, polymers and copolymers, and latex polymers as are known in the art. In a preferred embodiment, the sound damping material is an acrylic polymer or copolymer. One such non-limiting example is Acronal®, an acrylate copolymer commercially available from BASF (Charlotte, N.C.). The sound damping material may also comprise various additives, including anti-microbial materials for fungal protection and appropriate fillers such as, in non-limiting examples, vermiculite, expanded mica, talc, lead, and granulated polystyrene aluminum oxide. Additional embodiments include a tacky adhesive constructed of one or more polymers having fluidity at an ordinary temperature and one or more emulsion type or solvent type polymers consisting of one or more natural rubbers, synthetic rubbers, and polymers such as, in non-limiting examples, acrylic resin and silicone resin. A tackifier, including such non-limiting examples as petroleum resin and sap, a softener, and/or a plasticizer are included in the sound damping layer 14 in one or more embodiments of the present disclosure. Other non-limiting examples of materials used to form the sound damping layer 14 include polyester resins, resins constructed from plasticizers or peroxide being added to polyester, multiple polyesters, polyurethane foam, polyamide resin, ethylene-vinyl acetate copolymers, ethylene acrylic acid copolymers, polyurethane copolymers, and EPDM polymers. In one or more embodiments, the sound damping layer 14 comprises a polymer having a dynamic glass transition temperature at or below the working temperature at which the sound damping layer 14 will be used.

The sound damping layer 14 may be applied or positioned directly on the gypsum layer 12 or the third encasing layer 26, or both. In one or more embodiments, the sound damping layer 14 is positioned or applied directly on the gypsum layer inner surface 16 as a monolithic, homogenous layer. In an alternative embodiment, the third encasing layer 26 only partially covers the gypsum layer inner surface 16 of the gypsum layer 12 such that the sound damping layer 14 is positioned or applied on both the gypsum layer 12 and the third encasing layer 26. The sound damping layer 14 may cover substantially the entire surface of the gypsum layer 12 or the third encasing layer 26. In yet another embodiment, after the gypsum layer 12 is constructed using traditional gypsum wallboard manufacturing techniques and the sound damping layer 14 is positioned adjacent to or applied onto the gypsum layer 12 or third encasing layer 26, the wallboard 10 may then be encased to at least partially form the first encasing layer 20 and the second encasing layer 22. The first encasing layer 20 may comprise both encasing material from the original encasement of the gypsum layer 12 using traditional gypsum wallboard manufacturing techniques as well as encasing material used to encase the wallboard 10 following the formation of the sound damping layer 14.

In one or more embodiments, the first encasing layer 20, the second encasing layer 22, and/or the third encasing layer 26 comprises a material such as paper, fiberglass, foil, a polymer, or other materials known in the art. Additionally, the first encasing layer 20, the second encasing layer 22, or the third encasing layer 26 may be made of a low emittance or reflective material, or from virgin or recycled material. In one or more embodiments, the first encasing layer 20, the second encasing layer 22, or the third encasing layer 26 is constructed of a plurality of thin sheets of material having various thicknesses, each sheet having a thickness less than or equal to 0.001 inches. In one or more embodiments, each of the plurality of thin sheets of material has thickness less than or equal to 10-15 microns. In one or more embodiments, the second encasing layer 22 or the third encasing layer 26 may be constructed of or include a carrier sheet, such as a "peel & stick" layer, where the carrier sheet may be removed during the wallboard manufacturing or installation process. In an embodiment, the second encasing layer 22 is constructed of a carrier sheet that is removable prior to installation, as discussed in further detail below. As shown in FIG. 1, the encasement of the gypsum layer 12 and/or the encasement of the sound damping wallboard 10 may include a first edge encasing layer 40 and a second edge encasing layer (not shown) connecting the first encasing layer 20 to the second encasing layer 22 and/or the third encasing layer 26.

In an alternative embodiment, the second encasing layer 22 may comprise a coating that is applied to the sound damping layer inner surface 24. The coating may be applied by various means known in the art, such as spraying or brushing. In a preferred embodiment, the coating is curable composition that is applied to the sound damping layer inner surface 24 and then cured to form the second encasing layer 22. Suitable coatings include curable polymer compositions, such as acrylic polymer and copolymer compositions. In a preferred embodiment, the coating includes thermal or photo (e.g., UV) curing agents to facilitate curing of the second encasing layer 22.

Figure 2:
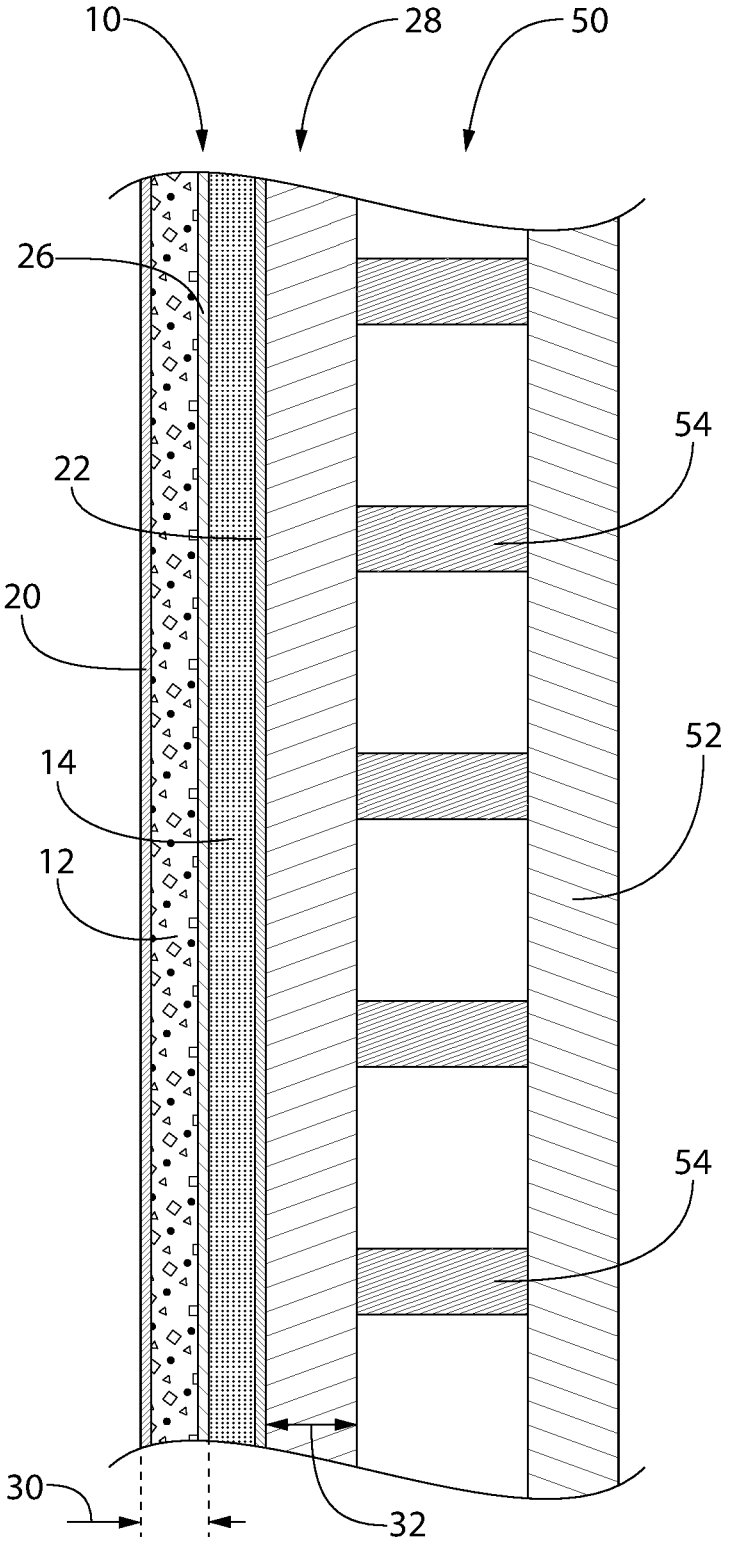
FIG. 2 is a cross sectional view of a sound damping wallboard and installed wallboard in accordance with further aspects of the present disclosure.

Referring now to FIG. 2, an embodiment of the present disclosure includes the sound damping wallboard 10 being installed such that the sound damping layer 14 is disposed between the gypsum layer 12 and an installed wallboard 28. As used in the present disclosure, the term "wallboard," especially with regard to the installed wallboard 28, generally refers to any panel, sheet, or planar structure, either uniform or formed by connected portions or pieces, that is constructed to at least partially establish one or more physical boundaries. The installed wallboard 28 forms part of a building structure, such as a wall or ceiling. In the embodiment shown in FIG. 2, the building structure is a vertically aligned building wall 50, which optionally has a second installed wallboard 52 connected to an opposite side of the building wall 50. The installed wallboards 28, 52 are connected via one or more studs 54 of a wall frame to form the structure of the building wall 50. One of ordinary skill will recognize the various methods and structures for fastening, adhering, or otherwise attaching or constructing the components of a wall or ceiling, including studs, plates, panels, wallboards, etc., to form a building structure such as a wall or ceiling, and such methods and structures are included in the present disclosure.

According to one or more embodiments, the sound damping wallboard 10 is installed in a flush relationship against the installed wallboard 28 with the sound damping inner layer 24 disposed at the installed wallboard 28, as shown in FIG. 2. The sound damping wallboard 10 is installed against the installed wallboard 28, in one embodiment, by mounting, attaching or otherwise fastening the sound damping wallboard 10 to the installed wallboard 28. For example, the sound damping wallboard 10 may be fastened to the installed wallboard 28 using all-purpose joint compound and fasteners, including such non-limiting examples as nails, screws, and laminating screws. Fastener locations and joints between sound damping wallboards 10 are treated, in an embodiment, using conventional drywall tape and joint compound.

In the embodiment shown in FIG. 2, the second encasing layer 22 remains positioned against the sound damping layer 14 during installation of the sound damping wallboard 10 on the installed wallboard 28. As shown in FIG. 2, the gypsum layer 12 of an embodiment has a gypsum layer thickness 30, the installed wallboard 28 of the embodiment has an installed wallboard thickness 32, and the gypsum layer thickness 30 is less than the installed wallboard thickness 32. The thickness of a conventional wallboard panel is typically ½ inch or ⅝ inch. Thus, in one embodiment, the gypsum layer thickness 30 is less than or equal to ⅝ inch. In an alternative embodiment, the gypsum layer thickness 30 is less than or equal to ½ inch. In a preferred embodiment, the gypsum layer thickness 30 is about 5/16 inch, and more preferably about ¼ inch.

As discussed above, the gypsum layer 12 of an embodiment has a higher density than a density of a gypsum layer of a conventional gypsum wallboard. The density of a gypsum layer of a conventional gypsum wallboard is typically between 1300 and 1650 lbs/msf for wallboards of ½ inch thickness and generally between 1750 and 2200 lbs/msf for wallboards of ⅝ inch thickness. The density of wallboard having a thickness of ¼ or 5/16 inches is between 1200 and 1400 lbs/msf. The gypsum layer 12 of an embodiment of the present disclosure has a higher density than these densities of the gypsum layers of the conventional gypsum wallboards. For example, in gypsum slurries that contain foam, the higher density may be achieved by manipulating the amount of foam in the gypsum slurry, or by other means known in the art. In a preferred embodiment, building wall 50 comprises an installed wallboard 28 with a gypsum layer having a first density (e.g., a conventional density), and the sound damping wallboard 10 has a gypsum layer 12 with a second density that is greater than the first density of the installed wallboard. The higher density of the sound damping wallboard 10, and the use of building wall structures where the sound damping wallboard and installed wallboard 28 have different densities are believed to contribute to improved sound damping.

As described above, in one embodiment, the second encasing layer 22 is removable such that the second encasing layer 22 is removed prior to installation of the sound damping wallboard 10 on the installed wallboard 28. In a preferred embodiment, the second encasing layer 22 may comprise an adhesive layer with a release sheet or carrier sheet, such as used in "peel & stick" applications, where the carrier sheet may be removed before the wallboard 10 is fastened to the installed wallboard 28 by contact with the adhesive. In embodiments where the sound damping layer 14 itself comprises a tacky or adhesive material, the second encasing layer 22 may comprise a release sheet without a further adhesive layer. For example, the release sheet may comprise a plastic film or paper sheet with a release coating, such as a silicone coating, as are known in the art.

Figure 3:
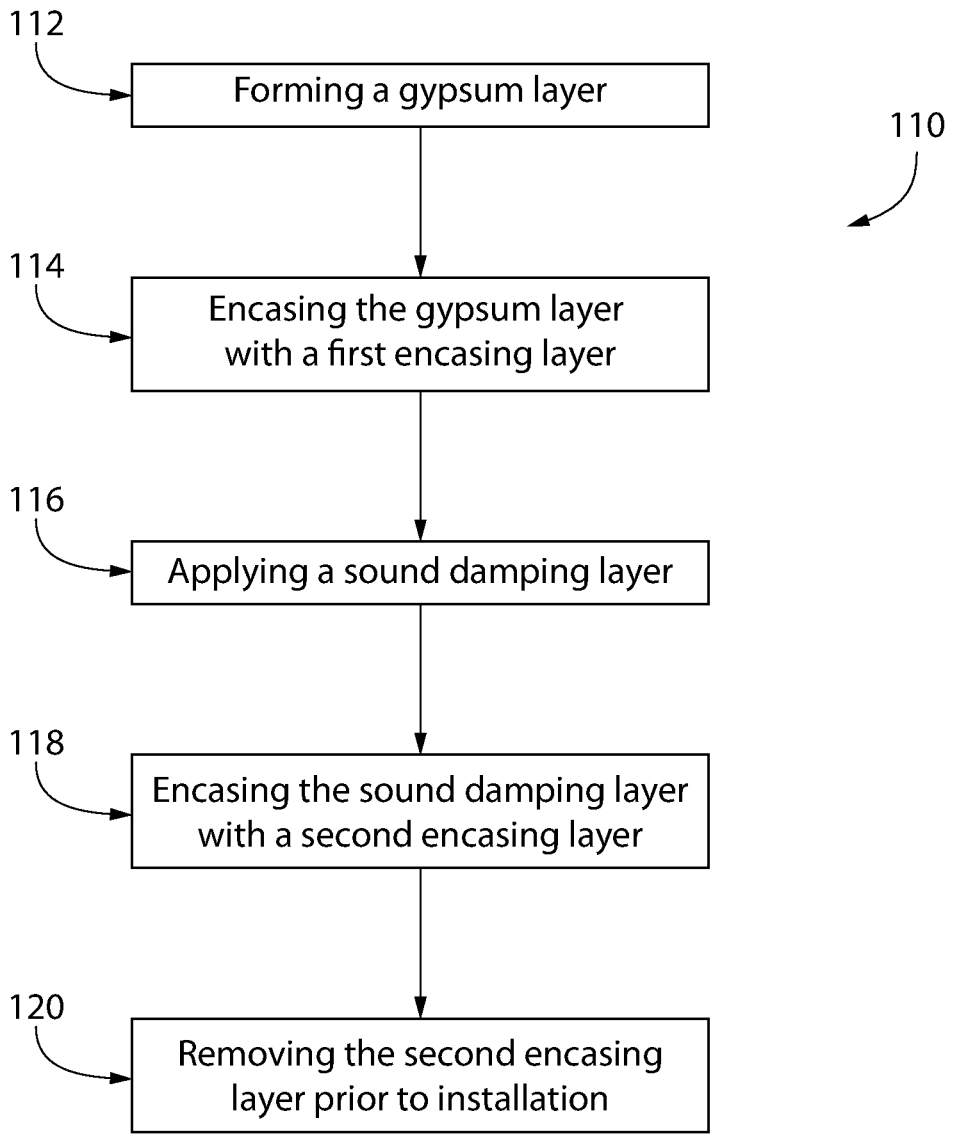
FIG. 3 illustrates a method of forming a sound damping wallboard in accordance with further aspects of the present disclosure.

Referring now to FIG. 3, one or more embodiments of the present disclosure include a method 110 of forming a sound damping wallboard 10 for installation on an installed wallboard 28. In an embodiment, the method 110 includes forming, at step 112, a gypsum layer 12 having a gypsum layer inner surface 16 and a gypsum layer outer surface 18 and encasing, at step 114, the gypsum layer 12 with a first encasing layer 20 disposed at the gypsum layer outer surface 18. In an embodiment, the method 110 further includes encasing the gypsum layer 12 with a third encasing layer 26 disposed at the gypsum layer inner surface 16. The method 110 further includes applying, at step 116, a sound damping layer 14 to the gypsum layer inner surface 16 such that the sound damping layer 14 includes a sound damping layer inner surface 24 opposite the gypsum layer inner surface 16 and encasing, at step 118, the sound damping layer 14 with a second encasing layer 22 disposed at the sound damping layer inner surface 24. The method 110 of one or more embodiments further includes removing, at step 120, the second encasing layer 22 prior to installation of the sound damping wallboard 10 on the installed wallboard 28. In an embodiment, the gypsum layer 12 is formed to a gypsum layer thickness 30 less than an installed wallboard thickness 32. In an embodiment, the gypsum layer 12 is formed to a gypsum layer thickness 30 that is about 5/16 inch or less, and more preferably about ¼ inch or less. In one or more embodiments, the sound damping layer 14 is comprised of an elastomer material. Any structures, materials, applications, or similar details described in the present disclosure with regard to the sound damping wallboard 10 may be incorporated into one or more embodiments of the method 110.

Figure 4:
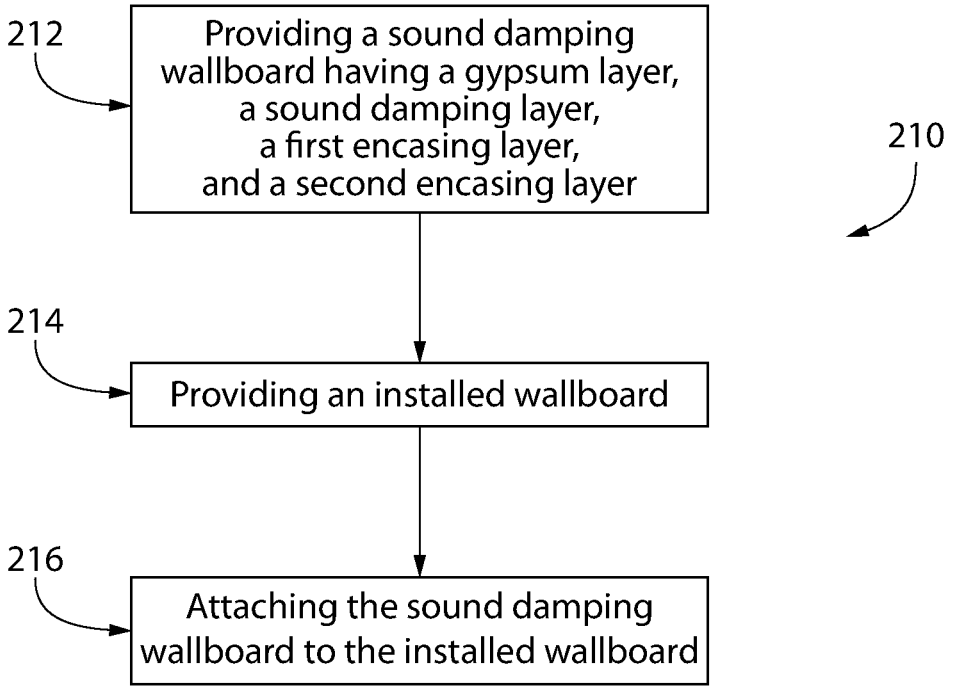
FIG. 4 illustrates a method of constructing a sound damping wall in accordance with further aspects of the present disclosure.

Referring now to FIG. 4, one or more embodiments of the present disclosure include a method 210 of constructing a sound damping wallboard 10. In an embodiment, the method 210 includes providing, at step 212, a sound damping wallboard 10 having a gypsum layer 12, a sound damping layer 14, a first encasing layer 20 disposed adjacent the gypsum layer 12, and a second encasing layer 22 disposed adjacent the sound damping layer 14. The method 210 further includes providing, at step 214, an installed wallboard 28 attached to a building wall or ceiling and attaching, at step 216, the sound damping wallboard 10 to the installed wallboard 28 such that the sound damping layer 14 is disposed between the gypsum layer 12 and the installed wallboard 28. In an embodiment, the method 210 further includes removing the second encasing layer 22 from the sound damping wallboard 10 prior to installing the sound damping wallboard 10 on the installed wallboard 28.

In an embodiment, the first encasing layer 20 is disposed at a gypsum layer outer surface 18 and the second encasing layer 22 is disposed at a sound damping layer inner surface 24. The gypsum layer 12 of an embodiment has a gypsum layer thickness 30, the installed wallboard 28 has an installed wallboard thickness 32, and the gypsum layer thickness 30 is less than the installed wallboard thickness 32. According to an embodiment, the gypsum layer 12 has a gypsum layer thickness 30 that is about 5/16 inch or less, and more preferably about ¼ inch or less. The sound damping layer 14 of an embodiment is a polymer material, and more preferably an elastomer. Any structures, materials, applications, or similar details described in the present disclosure with regard to the sound damping wallboard 10 may be incorporated into one or more embodiments of the method 210.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

Example 1

A sound damping wallboard was prepared comprising a ¼ inch gypsum layer and an Acronal® sound damping layer. A paper facing or encasing layer was disposed on either side of the sound damping wallboard and between the gypsum and sound damping layers. The sound damping wallboard was then attached or retrofit to a conventional ⅝ inch wallboard, as described above using standard gypsum wallboard fasteners. The retrofit sound damping wallboard was tested for sound transmission loss in a full scale wall test according to the ASTM E-90 standard. The results were compared to a control wallboard without the retrofit sound damping wallboard. The sound transmission loss in decibels (dB) was measured at various frequencies, as shown in Table 1 and FIG. 5.

TABLE 1

| | Sound Transmission Loss (dB) | | |
|---|---|---|---|
| Frequency (Hz) | Control (CW) | Retrofit (SDW) | Difference |
| 100 | 17 | 22 | 5 |
| 125 | 13 | 19 | 6 |
| 160 | 13 | 15 | 2 |
| 200 | 17 | 22 | 5 |
| 250 | 23 | 27 | 4 |
| 315 | 23 | 27 | 4 |
| 400 | 29 | 34 | 5 |
| 500 | 32 | 35 | 3 |
| 630 | 34 | 37 | 3 |
| 800 | 38 | 40 | 2 |
| 1000 | 40 | 43 | 3 |
| 1250 | 42 | 47 | 5 |
| 1600 | 44 | 50 | 6 |
| 2000 | 43 | 51 | 8 |
| 2500 | 36 | 48 | 12 |
| 3150 | 34 | 48 | 14 |
| 4000 | 38 | 50 | 12 |
| 5000 | 43 | 52 | 9 |

Figure 5:
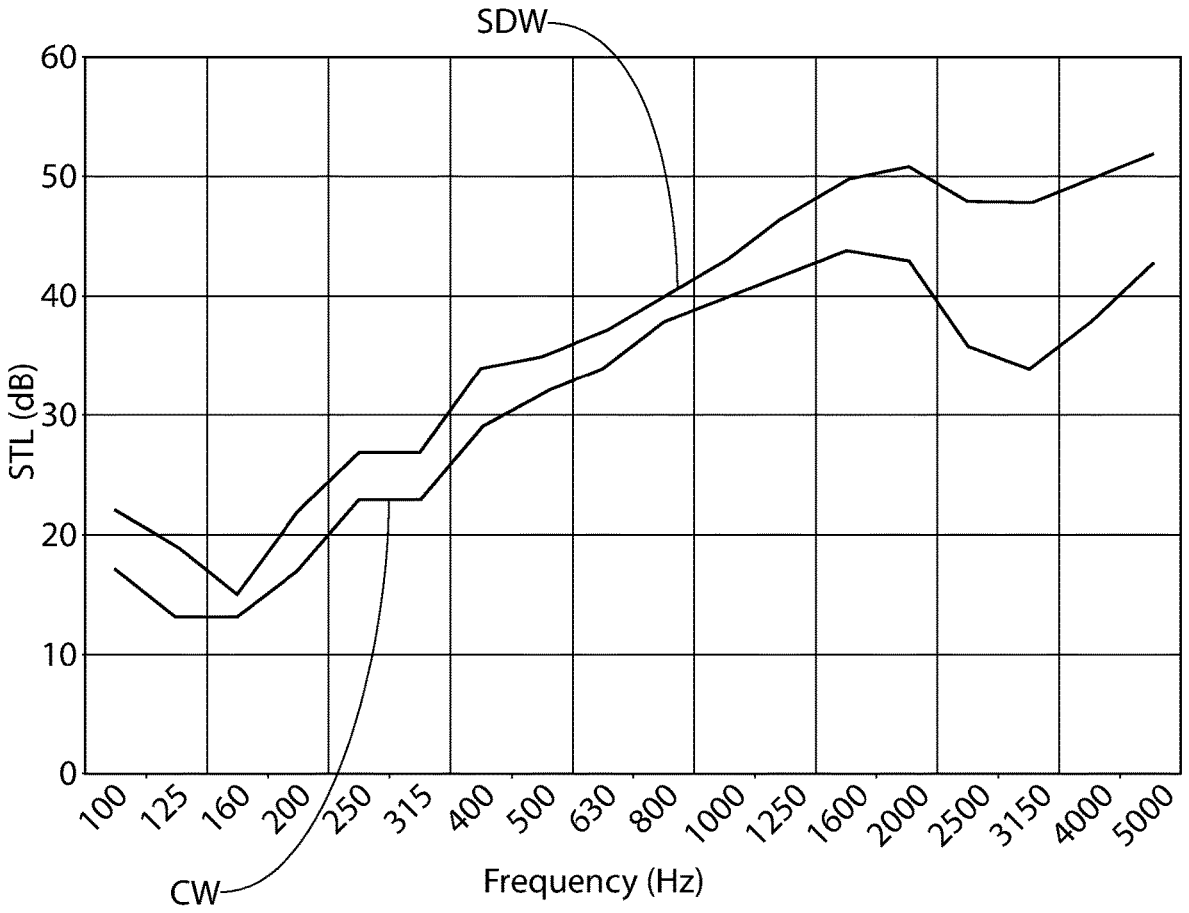
FIG. 5 is a data plot of frequency and sound transmission loss, that illustrates the performance of a sound damping wall in accordance with further aspects of the present disclosure.

As illustrated in the chart of FIG. 5, the sound damping wallboard 10 with the sound damping layer 14 provides enhanced acoustical performance in the Hertz ranges from 100 Hz to 5000 Hz. The sound transmission loss value of the sound damping wallboard 10 with sound damping layer 14, indicated by the line SDW, is substantially higher than a sound transmission loss value of a standard, non-damping control wallboard, indicated by the line CW. In particular, the retrofit sound damping wallboard 10 with the sound damping layer 14 of the embodiment of FIG. 5 provides improved acoustical performance, particularly in the Hertz range from 1250 Hz to 5000 Hz.

Example 2

Four test walls (Walls 1-4) utilizing different density materials were prepared and tested for acoustical performance. The walls were constructed of ⅝ inch gypsum wallboard over steel studs and insulation, and were assembled using conventional construction techniques. Except as noted, the gypsum wallboard comprised a conventional density gypsum layer and was commercially available as Gold Bond® Fire-Shield® Gypsum Board (National Gypsum Company, Charlotte, N.C.).

Wall 1 was constructed with a ⅝ inch gypsum wallboard on each side of the wall assembly. Wall 2 was constructed with two ⅝ inch gypsum wallboards on the first side of the wall assembly, and one ⅝ inch gypsum wallboard on the second side of the wall assembly. Wall 3 was constructed with a ⅝ inch gypsum wallboard and a ⅝ inch sound damping wallboard on the first side of the wall assembly, and one ⅝ inch gypsum wallboard on the second side of the wall assembly. The sound damping wallboard of Wall 3 comprised an Acronal® sound damping layer sandwiched between two ¼ inch gypsum boards having higher density gypsum layers. Wall 4 was constructed with a ⅝ inch gypsum wallboard and a ¼ inch sound damping wallboard on the first side of the wall assembly, and one ⅝ inch gypsum wallboard on the second side of the wall assembly. The sound damping wallboard of Wall 4 comprised an Acronal® sound damping layer applied to a single ¼ inch gypsum board having a higher density gypsum layer.

Figure 6:
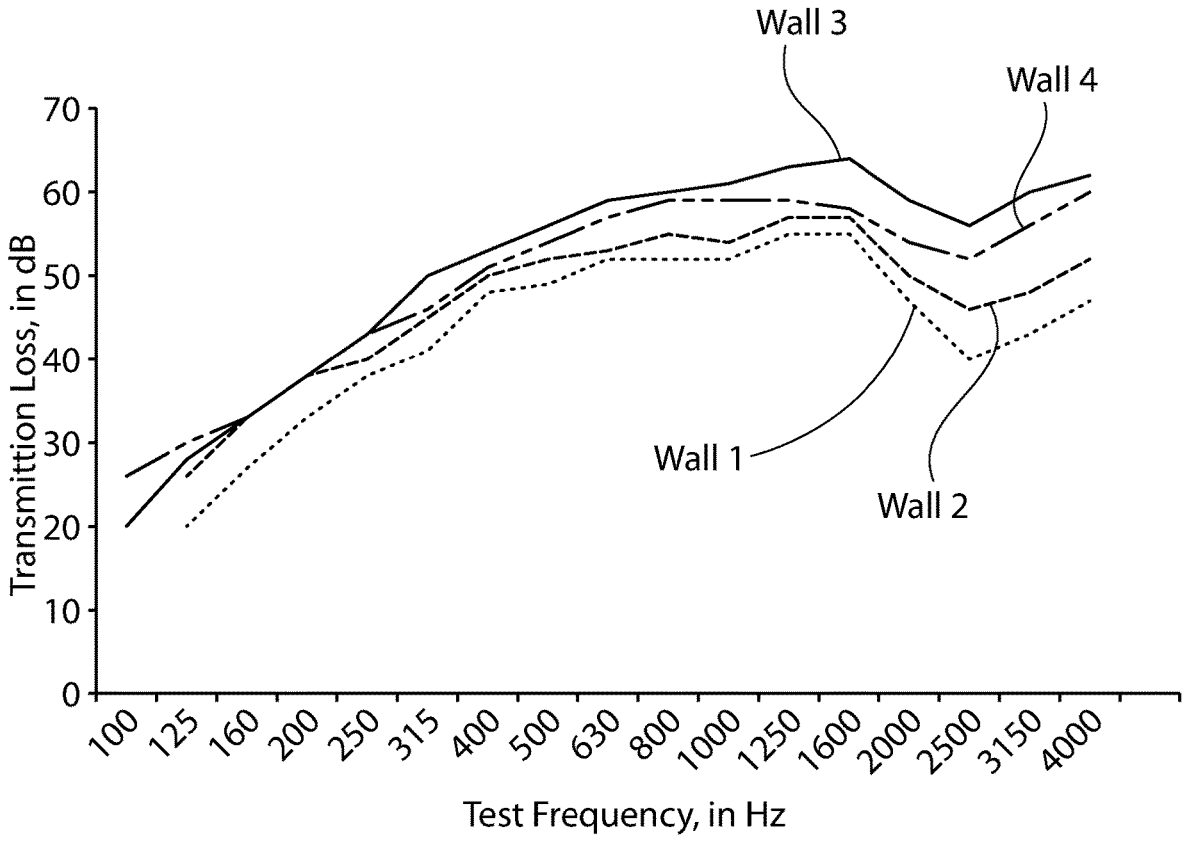
FIG. 6 is a data plot of frequency and sound transmission loss, that illustrates the performance of alternative embodiments of a sound damping wall in accordance with further aspects of the present disclosure.

Walls 1-4 were tested for sound transmission loss in a full scale wall test according to the ASTM E-90 standard. The sound transmission loss in decibels (dB) was measured at various frequencies, as shown in Table 2 and FIG. 6. As shown in FIG. 6, the retrofit addition of a sound damping wallboard (Walls 3, 4) was found to provide significant improvement in sound transmission loss over conventional construction Wall (1) or the use of two conventional wallboard panels (Wall 2). Furthermore, the sound damping wallboards comprising two gypsum boards (Wall 3) and only one gypsum board (Wall 4) were found to fall within the same STC rating.

TABLE 2

| | Sound Transmission Loss (dB) | | | |
|---|---|---|---|---|
| Frequency (Hz) | Wall 1 | Wall 2 | Wall 3 | Wall 4 |
| 100 | — | — | 20 | 26 |
| 125 | 20 | 26 | 28 | 30 |
| 160 | 27 | 33 | 33 | 33 |
| 200 | 33 | 38 | 38 | 38 |
| 250 | 38 | 40 | 43 | 43 |
| 315 | 41 | 45 | 50 | 46 |
| 400 | 48 | 50 | 53 | 51 |
| 500 | 49 | 52 | 56 | 54 |
| 630 | 52 | 53 | 59 | 57 |
| 800 | 52 | 55 | 60 | 59 |
| 1000 | 52 | 54 | 61 | 59 |
| 1250 | 55 | 57 | 63 | 59 |
| 1600 | 55 | 57 | 64 | 58 |
| 2000 | 47 | 50 | 59 | 54 |
| 2500 | 40 | 46 | 56 | 52 |

TABLE 2-continued

| | Sound Transmission Loss (dB) | | | |
|---|---|---|---|---|
| Frequency (Hz) | Wall 1 | Wall 2 | Wall 3 | Wall 4 |
| 3150 | 43 | 48 | 60 | 56 |
| 4000 | 47 | 52 | 62 | 60 |

The sound damping wallboard 10 according to an embodiment of the present disclosure improves the acoustical performance of an existing, installed, or otherwise established wallboard, wall panel, ceiling panel, or similar structural boundary or surface. Such existing, installed, or otherwise established wall or ceiling structures comprise materials that may include, as non-limiting examples, gypsum, stone, ceramic, wood, composite, or metal materials. One of ordinary skill will recognize the sound damping benefit and applicability of the sound damping wallboard and methods of the present disclosure to the many structures and materials used to form wall and ceiling structures.

The sound damping wallboard 10 according to an embodiment of the present disclosure is sufficiently thin to allow its installation onto a wall or ceiling without substantially increasing an overall wall or ceiling thickness. Further, the sound damping wallboard 10 of the present disclosure is sufficiently thin to avoid significant modifications to installed wall and ceiling objects, such as existing wall or ceiling outlets, switches, or ceiling fixtures, thereby reducing the time, labor, and materials needed to improve existing walls and ceilings by renovating or retrofitting the walls or ceilings with sound damping material.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

We claim:

1. A sound damping wallboard system for a building structure comprising a first wallboard fastened to the building structure, comprising:

a second wallboard comprising:

a gypsum layer having a gypsum layer inner surface and a gypsum layer outer surface;

a sound damping layer disposed at the gypsum layer inner surface, and having a sound damping layer inner surface opposite the gypsum layer inner surface;

wherein the sound damping layer is formed by applying an adhesive composition comprising a dispersion including an acrylate copolymer and water at the gypsum layer inner surface;

a first encasing layer disposed at the gypsum layer outer surface;

a second encasing layer disposed at the sound damping layer inner surface, wherein the second encasing layer is formed of a material comprising paper, fiberglass, foil, a polymer, or a combination thereof; and wherein the second wallboard is fastened to the first wallboard with the sound damping layer disposed between the gypsum layer and the first wallboard.

2. The sound damping wallboard system of claim 1, wherein the sound damping wallboard includes a third encasing layer between the gypsum layer and the sound damping layer.

3. The sound damping wallboard system of claim 1, wherein the first wallboard has a first wallboard thickness, and the gypsum layer has a gypsum layer thickness that is less than the first wallboard thickness.

4. The sound damping wallboard system of claim 1, wherein the gypsum layer has a gypsum layer thickness that is about 5/16 inch or less.

5. The sound damping wallboard system of claim 1, wherein the gypsum layer has a gypsum layer thickness that is about ¼ inch or less.

6. The sound damping wallboard system of claim 1, wherein the first wallboard comprises a first wallboard gypsum layer having a first density, and the second wallboard comprises a second wallboard gypsum layer having a second density that is greater than the first density.

7. A method of constructing a sound damping wallboard on a building structure comprising a first wallboard fastened to the building structure, comprising the steps of:

fastening a second wallboard to the first wallboard wherein the second wallboard comprises a gypsum layer having a gypsum layer inner surface and a gypsum layer outer surface, a sound damping layer having a first surface disposed at the gypsum layer inner surface and a second surface opposite the first surface, wherein the sound damping layer is formed by applying an adhesive composition comprising a dispersion including an acrylate copolymer and water at the gypsum layer inner surface, a first encasing layer disposed at the gypsum layer outer surface;

a second encasing layer disposed at the sound damping layer second surface, wherein the second encasing layer is formed of a material comprising paper, fiberglass, foil, a polymer, or a combination thereof; and wherein the second wallboard is fastened to the first wallboard with the sound damping layer disposed between the gypsum layer and the first wallboard.

8. The method of claim 7, wherein the gypsum layer has a gypsum layer thickness that is about 5/16 inch or less.

9. The method of claim 7, wherein the gypsum layer has a gypsum layer thickness that is about ¼ inch or less.

10. The method of claim 7, wherein the sound damping layer comprises an elastomer.

11. The method of claim 7, wherein the first wallboard has a first wallboard thickness, and the gypsum layer has a gypsum layer thickness that is less than the first wallboard thickness.

12. The method of claim 7, further comprising the step of removing the second encasing layer from the second wallboard prior to fastening the second wallboard to the first wallboard.

13. The method of claim 7, wherein the second encasing layer comprises an adhesive and carrier sheet, and further comprising the steps of removing the carrier sheet, and fastening the second wallboard to the first wallboard by contact with the adhesive.

14. The method of claim 7, wherein the first wallboard comprises a first wallboard gypsum layer having a first density, and the second wallboard comprises a second wallboard gypsum layer having a second density that is greater than the first density.

* * * * *